US008431853B2

(12) United States Patent
Kwak

(10) Patent No.: US 8,431,853 B2
(45) Date of Patent: Apr. 30, 2013

(54) METAL DOME SWITCH FOR KEYPAD

(75) Inventor: Young-Kap Kwak, Seoul (KR)

(73) Assignee: Magma Co., Ltd., Gimpo-Si, Gyeonggi-Do (KR)

( * ) Notice: Subject to any disclaimer, the term of this patent is extended or adjusted under 35 U.S.C. 154(b) by 355 days.

(21) Appl. No.: 12/943,548

(22) Filed: Nov. 10, 2010

(65) Prior Publication Data

US 2011/0278148 A1 Nov. 17, 2011

(30) Foreign Application Priority Data

May 11, 2010 (KR) ..... 20-2010-0004934

(51) Int. Cl.
*H01H 1/10* (2006.01)

(52) U.S. Cl.
USPC ..... 200/513; 200/406

(58) Field of Classification Search ..... 200/513, 200/406; 29/622
See application file for complete search history.

(56) References Cited

U.S. PATENT DOCUMENTS 7,919,719 B2 * 4/2011 Chang ..... 200/513

* cited by examiner

*Primary Examiner* — Vanessa Girardi
(74) *Attorney, Agent, or Firm* — Kile Park Reed & Houtteman PLLC

(57) ABSTRACT

Disclosed is a metal dome switch for a keypad capable of maintaining click sensitivity in an optimal state upon a push operation of a key button by forming a large height of an uplift part while maintaining structural strength of the uplift part, and increasing a height of a pressure concentration projection projecting upward from an apex of a dome-shaped metal plate while minimizing deformation in outer appearance and dimension of the metal dome switch, when the pressure concentration projection is press formed through a press forming process such as a bending process or a half-blanking process.

6 Claims, 9 Drawing Sheets

Fig. 1- Prior Art
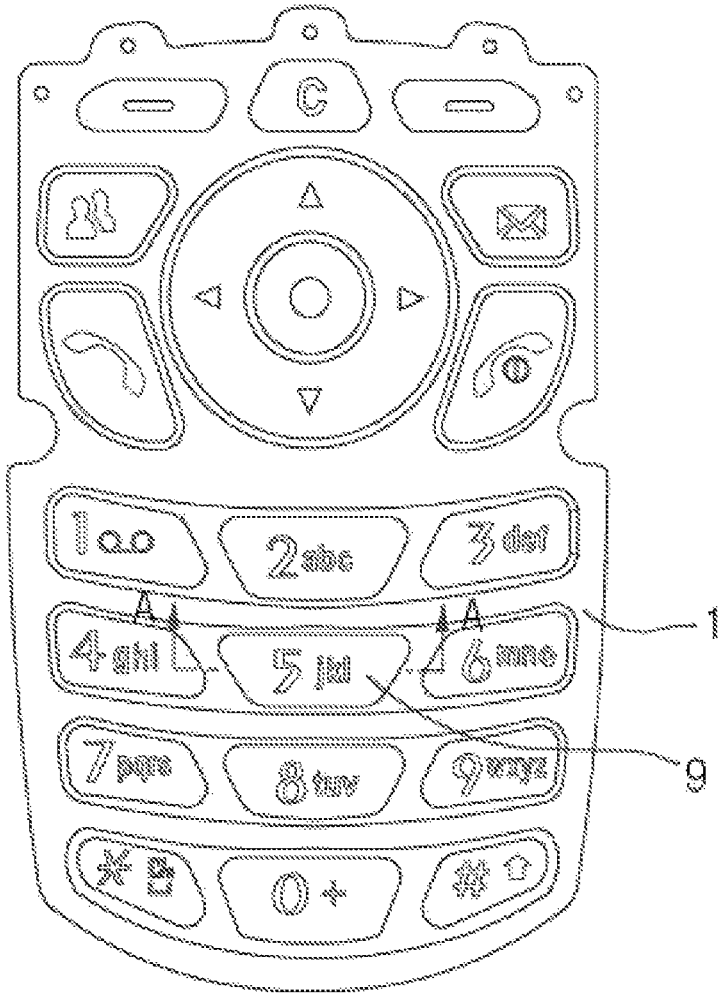

Fig. 2- Prior Art
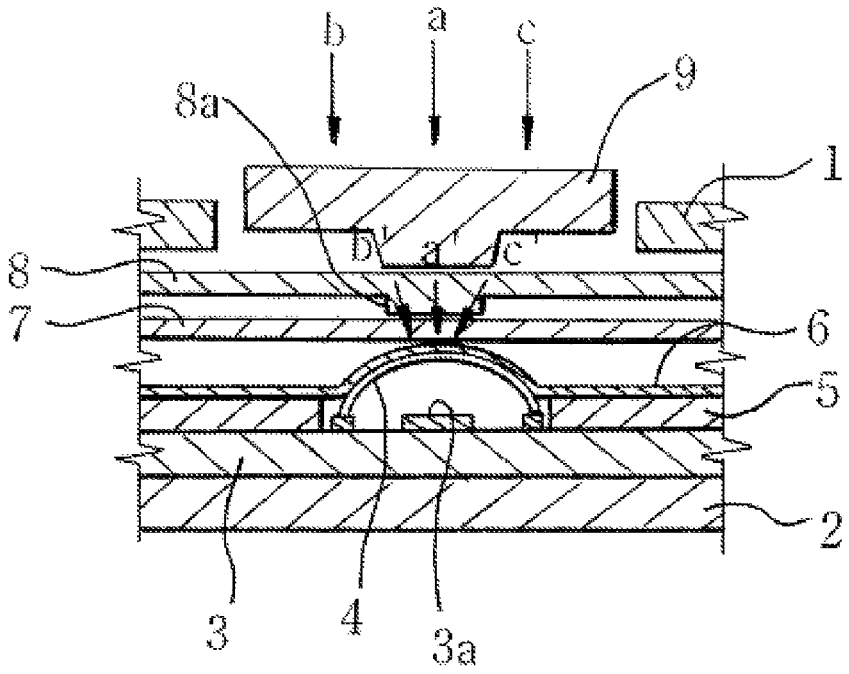

Fig. 3A- Prior Art
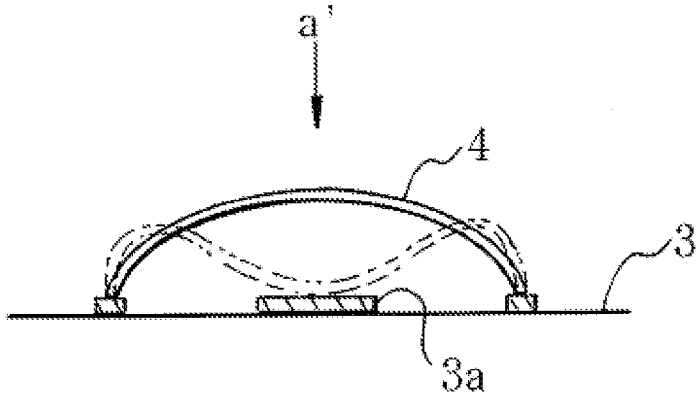
Fig. 3B- Prior Art
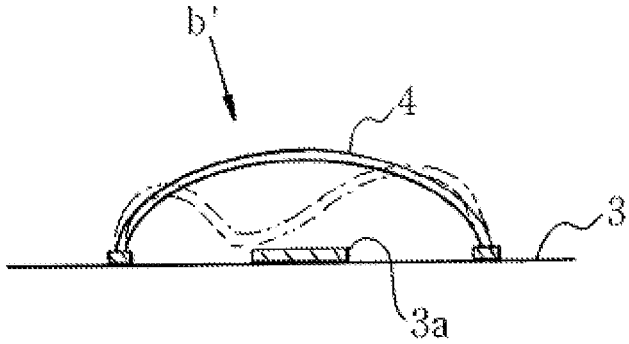

Fig. 4- Prior Art
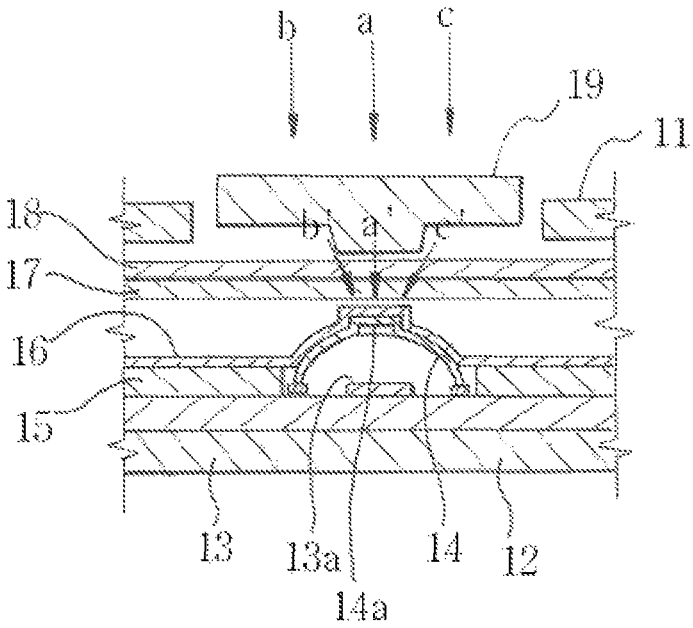

Fig. 5A- Prior Art
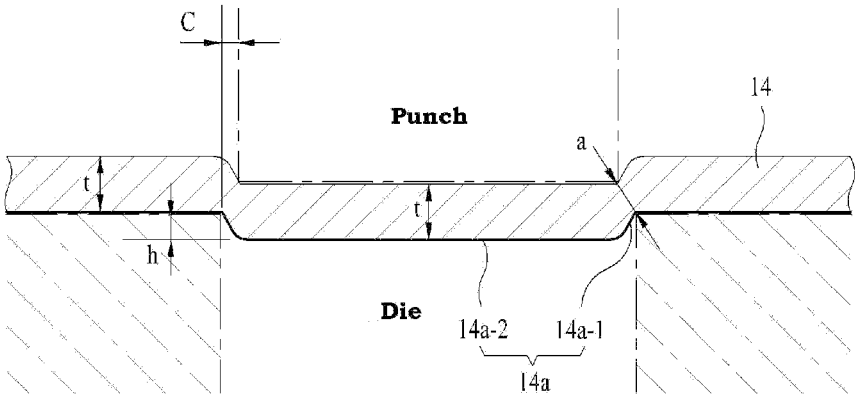
Fig. 5B - Prior Art
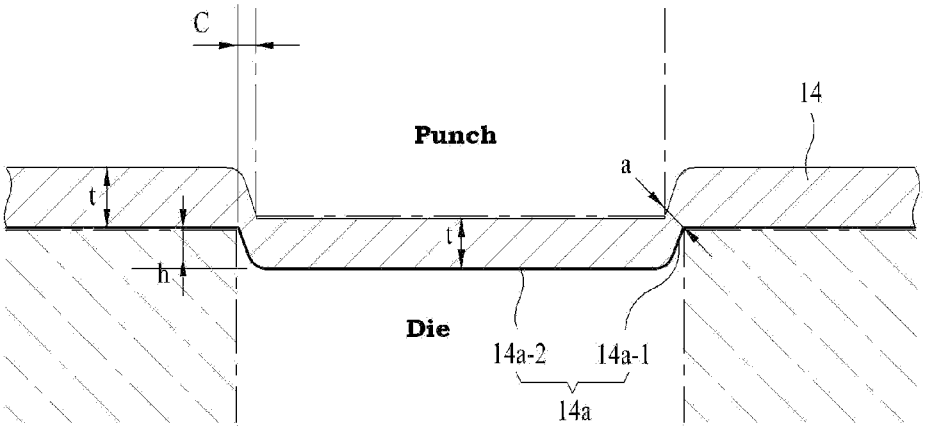

METAL DOME SWITCH FOR KEYPAD

CROSS-REFERENCE TO RELATED APPLICATION

This application claims priority to and the benefit of Korean Utility Model Application No. 2010-0004934, filed on May 11, 2010, the disclosure of which is incorporated herein by reference in its entirety.

BACKGROUND OF THE INVENTION

1. Field of the Invention

The present invention relates to a metal dome switch for a keypad, and more particularly, to a metal dome switch for a keypad in which an apex of a dome-shaped metal plate can be normally elastically deformed in a concave shape to always accurately perform a switching function and click sensitivity can be optimally maintained, even when a center part of a key button installed in a keypad of a mobile terminal, etc., is inaccurately pushed.

2. Discussion of Related Art

In general, as shown in FIGS. 1 and 2, a keypad used in a mobile terminal such as a mobile phone includes upper and lower cases 1 and 2 vertically spaced apart a predetermined distance from each other, a printed circuit board 3 mounted on the lower case 2 and having an upper surface on which connection terminals 3*a* are formed, a plurality of metal dome switches 4 disposed on the printed circuit board 3 to perform a switching function by selectively contacting and being spaced apart from the connection terminals 3*a*, a spacer 5 provided on the printed circuit board 3 and on which the metal dome switches 4 are installed, a tape 6 adhered to the spacer 5 to fix the metal dome switches 4, a light guide plate 7 installed on the metal dome switch 4 to emit light received from a lamp (not shown) to a surface thereof, an upper sheet 8 disposed on the light guide plate 7 and made of a synthetic resin, and key buttons 9 installed in the upper case 1 to press and elastically deform the metal dome switches 4.

Therefore, as a user pushes and releases the key button 9 with his/her finger, as shown in FIG. 3A, the apex of the metal dome switch 4 is elastically deformed in a concave shape to contact and be spaced apart from the connection terminal 3*a*, performing a switching function.

In addition, a pressure concentration projection 8*a* is formed on a lower surface of the upper sheet 8, on which the metal dome switch 4 is disposed. The pressure concentration projection 8*a* is configured such that a pressure applied by a push operation of the key button 9 is concentrated to the apex of the metal dome switch 4 to normally elastically deform the metal dome switch 4, accurately performing a switching function and improving click sensitivity upon the push operation of the key button 9.

However, in the conventional keypad for a mobile phone, as shown in FIG. 2, only when a user accurately pushes the center of the key button 9 in an arrow direction a, the pressure concentration projection 8*a* of the upper sheet 8 presses the center of the metal dome switch 4 in an arrow direction a'. As a result, as shown in FIG. 3A, the apex of the dome-shaped metal plate is elastically deformed downward to perform a normal switching function, improving the click sensitivity. However, when a user carelessly pushes a peripheral part of the key button 9 other than the center thereof in an arrow direction b or c, the pressure concentration projection 8*a* of the upper sheet 8 also presses a peripheral part of the metal dome switch 4 other than the center thereof in an inclined arrow direction b' or c'.

In this case, as shown in FIG. 3B, since the apex of the metal dome switch 4 has a dome-shaped curve, a portion of the metal dome switch 4 to which the pressure is applied is elastically deformed to a large extent, and an opposite portion to which the pressure is not applied is elastically deformed to a small extent.

Therefore, the apex of the metal dome switch 4 is elastically deformed while leaning to one side so that the apex is not in contact with the connection terminal 3*a* to cause malfunction thereof, making a user cumbersomely push the key button 9 again. In addition, even when the metal dome switch 4 is in contact with the connection terminal 3*a* to perform the switching function, click sensitivity may be remarkably decreased.

Moreover, when the upper sheet 8 moves in the keypad and thus the pressure concentration projection 8*a* is deviated from the center of the metal dome switch 4 even to a small extent, it is difficult to accurately push the center of the key button 9 to normally elastically deform the apex of the metal dome switch 4 in a concave shape, decreasing the switching function. In order to solve the problem, in the conventional art, while the upper sheet 8 is securely fixed to the printed circuit board 3, etc., to prevent movement of the upper sheet 8, a process of assembling the keypad becomes cumbersome, and assemblability and productivity are also decreased due to addition of the assembly process.

Such problems could be solved by, as shown in FIG. 4, removing the pressure concentration projection formed at the upper sheet 18 and providing a pressure concentration projection 14*a* projecting upward from an apex of a metal dome switch 14 so that a pressure of a key button 19 is concentrated to the apex of the metal dome switch 14 through the pressure concentration projection 14*a*.

The metal dome switch 14 must have the pressure concentration projection 14*a* having a predetermined height sufficient to maintain the click sensitivity in an optimal state upon a push operation of the key button 19. However, since the height of the pressure concentration projection 14*a* is limited, the click sensitivity cannot be maintained in an optimal state.

The conventional metal dome switch 14 is formed of a thin stainless steel plate having high elasticity. As shown in FIG. 5A, the pressure concentration projection 14*a* includes an uplift part 14*a*-1 projecting from the dome-shaped metal plate, and a pressing surface 14*a*-2 horizontally extending from the uplift part 14*a*-1. The pressure concentration projection 14*a* is formed by a press forming process such as a bending process or a half-blanking process in which a clearance c between a punch diameter and a die hole is set to a very small size.

The bending process and the half-blanking process, which are similar press forming methods, are distinguished in that clearances c between a punch diameter and a die hole are set to 0.3 to 1 t and 0.03 to 0.1 t with respect to a thickness t of each material. When a small projection such as the pressure concentration projection 14*a* is formed at the metal dome switch made of a stainless steel material having higher elasticity than that of another press forming method, it is possible to accurately form the pressure concentration projection 14*a* at a desired position while minimizing deformation in outer appearance and dimension of the metal dome switch. However, it is difficult to apply a press forming process such as a drawing process of forming a soft metal material to form the pressure concentration projection 14*a* of the metal dome switch made of a stainless steel material having high elasticity, because deformation in outer appearance and dimension of the metal dome switch becomes severe.

However, as shown in FIGS. 5A and 5B, in the case of the bending process or the half-blanking process, a thickness a of the uplift part 14*a*-1 is reduced in proportion to a height h of the pressure concentration projection 14*a* to be formed. That is, as shown in FIG. 5A, when the height h of the uplift part 14*a*-1 is formed to ½ t or less of a thickness t of a metal plate, variation in thickness b of the uplift part 14*a*-1 is reduced to maintain structural strength thereof to some extent. However, as shown in FIG. 5B, when the height h is formed to ½ t or more of the thickness t of the metal plate, the thickness a of the uplift part 14*a*-1 is also reduced. In this case, since the structural strength of the uplift part 14*a*-1 is weakened and severe cracks are generated, such a pressure concentration projection 14*a*-1 cannot be applied to a keypad due to characteristics of the metal dome switch that must be repeatedly operated hundreds of thousands of times. In particular, in the case of the half-blanking process in which the clearance between the punch diameter and the die hole is set to a smaller size than that of the bending process, the thickness a of the uplift part 14*a*-1 is further reduced to weaken the structural strength, and in severe cases, the uplift part may be broken, making it impossible to apply the pressure concentration projection to the keypad.

Therefore, since it is difficult to form the height of the uplift part 14*a*-1 of the pressure concentration projection 14*a* to ½ t or more of the material thickness through the conventional press forming process such as the bending process or the half-blanking process, the projection thickness of the pressure concentration projection 14*a* is too small to accomplish optimal click sensitivity upon the push operation of the key button.

SUMMARY OF THE INVENTION

In order to solve the above problems, the present invention is directed to a metal dome switch for a keypad capable of maintaining click sensitivity in an optimal state upon a push operation of a key button by forming a large height of an uplift part while maintaining structural strength of the uplift part, and increasing a height of a pressure concentration projection projecting upward from an apex of a dome-shaped metal plate while minimizing deformation in outer appearance and dimension of the metal dome switch, when the pressure concentration projection is press formed through a press forming process such as a bending process or a half-blanking process.

According to an aspect of the present invention, there is provided a metal dome switch for a keypad having a pressure concentration projection projecting from an apex of a dome-shaped metal plate and having an uplift part and a pressing surface, characterized in that the uplift part of the pressure concentration projection has a step shape formed of a plurality of uplift surfaces and a plurality of step surfaces by a press forming process such as a bending process or a half-blanking process using a punch and a die.

Here, the total height of the uplift part may be formed to 1.0 to 3.0 times of a material thickness of the metal plate, and the total height of the uplift part may be determined by setting the number of the uplift surfaces and a height of each uplift surface. The plurality of uplift surfaces may be constituted by first to third uplift surfaces, and each height of the first to third uplift surfaces may be formed to ⅓ to ½ of the material thickness of the metal plate.

In addition, the plurality of step surfaces may be inclined in a projecting direction of the pressure concentration projection.

Further, a plurality of downward contact protrusions may protrude downward from a periphery of the pressure concentration projection, and the stepped pressure concentration projection may project in an annular shape.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which:

FIG. 1 is a plan view showing major parts of a keypad for a conventional mobile phone;

FIG. 2 is a cross-sectional view taken along line A-A of FIG. 1;

FIGS. 3A and 3B are enlarged cross-sectional views showing an operation state of a conventional metal dome switch;

FIG. 4 is a cross-sectional view showing configurations of major parts of a keypad for a mobile phone in which another conventional metal dome switch is installed;

FIGS. 5A and 5B are enlarged cross-sectional views showing a process of forming a pressure concentration projection of a conventional metal dome switch through a press forming process using a punch and a die;

DETAILED DESCRIPTION OF EXEMPLARY EMBODIMENTS

Exemplary embodiments of the present invention will be described in detail below with reference to the accompanying drawings.

Figure 6:
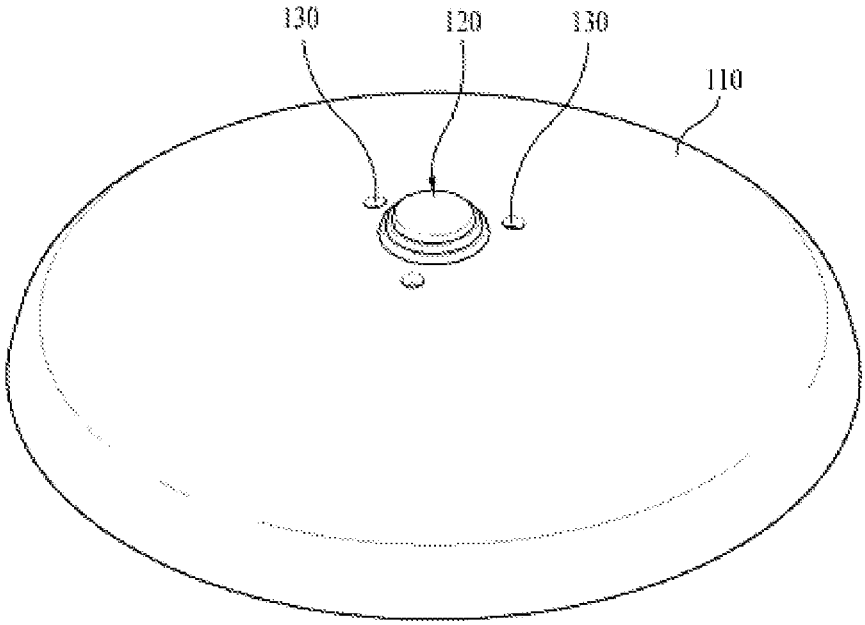
FIG. 6 is a perspective view of a metal dome switch in accordance with the present invention.
Figure 7:
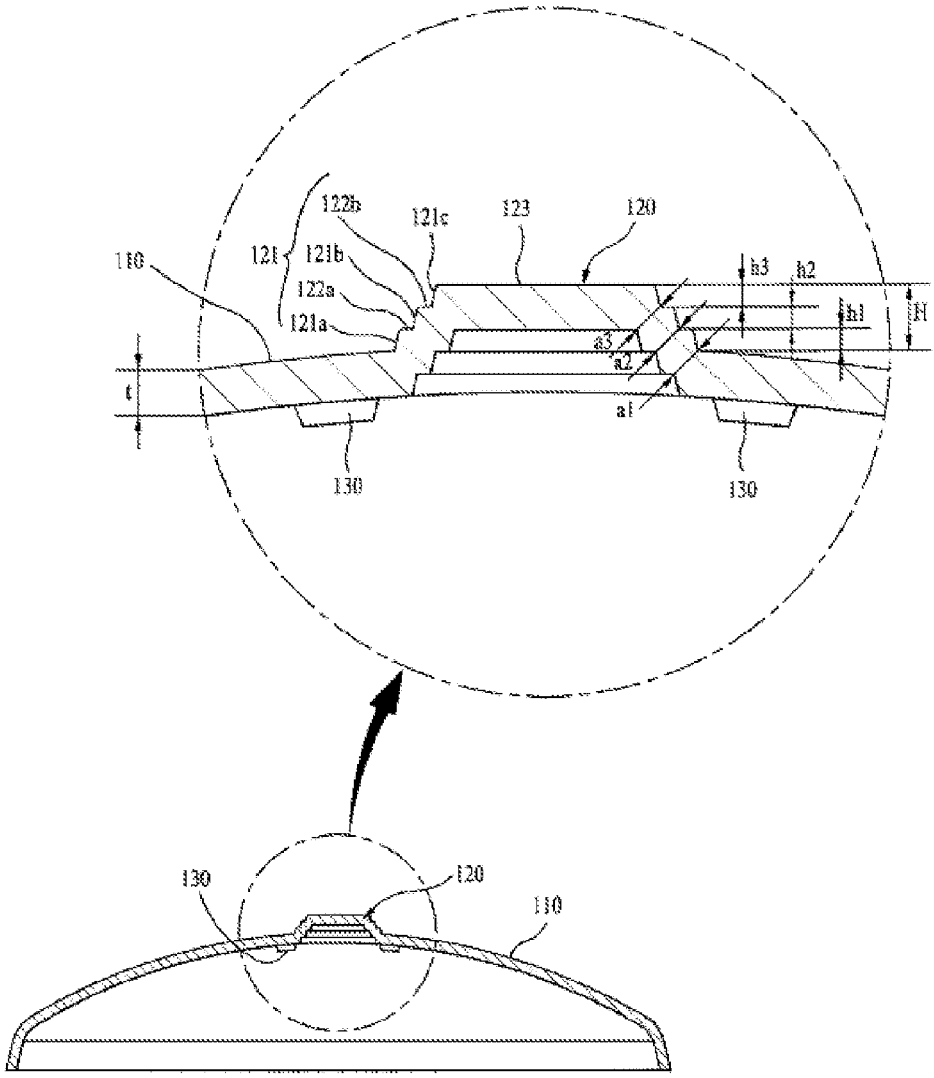
FIG. 7 is a cross-sectional view of the metal dome switch shown in FIG. 6.

FIGS. 6 and 7 are a perspective view and a cross-sectional view of a metal dome switch for a keypad in accordance with an exemplary embodiment of the present invention. As shown in the drawings, the metal dome switch of the present invention is made of a dome-shaped metal plate 110 formed by pressing a stainless steel thin plate having high elasticity. In the metal dome switch, a pressure concentration projection 120 projects upward from an apex of the dome-shaped metal plate 110, and a plurality of contact protrusions 130 project downward from a periphery of the pressure concentration projection 120 to improve an electrical contact function with a connection terminal of a printed circuit board.

Therefore, when a key button (not shown) is pressed, a pressing force is concentrated to the pressure concentration projection 120 to elastically deform the apex of the dome-shaped metal plate 110 in a downward concave direction to contact the connection terminal of the printed circuit board, performing a switching function. At this time, the plurality of contact protrusions 130 induce a plurality of point contacts with the connection terminal to prevent generation of contact errors due to foreign substances existing on the connection terminal.

The pressure concentration projection 120 of the metal dome switch is constituted by an uplift part 121 projecting upward from the apex of the metal plate 110 and a pressing surface 123. The uplift part 121 has a stepped shape formed of a plurality of uplift surfaces 121*a*, 121*b* and 121*c* and a plurality of step surfaces 122*a* and 122*b* elongated from the plurality of uplift surfaces 121*a*, 121*b* and 121*c*.

The stepped pressure concentration projection 120 is formed by a press forming process such as a bending process or a half-blanking process using a punch and a die. The stepped pressure concentration projection 120 may be formed by punching each stage using three sets of punches and dies having different sizes, or punching all the stages at one time using one set of a punch and die having a stepped shape.

When the pressure concentration projection 120 is formed in the stepped shape as described above, the total height H of the pressure concentration projection 120 may be formed to 1.0 t or more of a material thickness t of a metal plate while maintaining structural strength of the respective uplift surfaces 121*a*, 121*b* and 121*c* even through the bending process or the half-blanking process in which a clearance between the punch diameter and the die hole is set to a very small size.

For example, as described in this embodiment, when the pressure concentration projection 120 is formed in a three-step shape having the first to third uplift surfaces 121*a*, 121*b* and 121*c* and the first and second step surface 122*a* and 122*b*, as shown in FIG. 7, provided that the respective heights h1, h2 and h3 of the first to third uplift surfaces 121*a*, 121*b* and 121*c* are set to ⅓ to ½ t with respect to the material thickness t of the dome-shaped metal plate 110, the respective thicknesses a1, a2 and a3 of the first to third uplift surfaces 121*a*, 121*b* and 121*c* are configured to maintain the structural strength and the total heights H of the first to third uplift surfaces 121*a*, 121*b* and 121*c* are formed to 1 to 1.5 t, improving the click sensitivity.

In addition, while not shown in the drawings, when the uplift part 121 of the pressure concentration projection 120 projects in a two-step shape having first and second uplift surfaces and a first step surface, the total height H of the first and second uplift surfaces are formed to 1 t. When the uplift part 121 projects in a four- to six-step shape, the total height H of the uplift part 121 may be formed to 2.0 to 3.0 t.

As described above, when a press forming process such as a bending process or a half-blanking process is performed such that a clearance between the punch diameter and the die hole is set to a very small size, the total height H of the uplift part 121 of the processed pressure concentration projection 120 may be formed to 1 t or more with respect to the material thickness t of the metal plate by setting the number of the uplift surfaces and the step surfaces and the height h of each uplift surface. Therefore, the structural strength of the pressure concentration projection 120 can be maintained and the height of the pressure concentration projection can also be formed to a higher level than that of the conventional art, maintaining optimal click sensitivity upon a push operation of the key button. In addition, when a very small projection such as the pressure concentration projection 120 is formed to a large height in a step shape at the metal dome switch formed of a stainless steel material having high elasticity, it is possible to form the pressure concentration projection at a desired position while minimizing deformation in appearance and dimension of the metal dome switch.

In addition, a plurality of downward contact protrusions 130 project downward from a periphery of the pressure concentration projection 120. When the apex of the metal dome switch is deformed downward in a convex shape to electrically contact the connection terminal of the printed circuit board, the downward contact protrusions 130 function to induce a plurality of point contacts with the connection terminal, preventing generation of contact errors due to a presence of foreign substance on the connection terminal.

As shown in FIG. 6, three downward contact protrusions 130 may be formed at an interval of 120°, and while not shown in the drawings, four downward contact protrusions may be formed at an interval of 90°.

Figure 8:
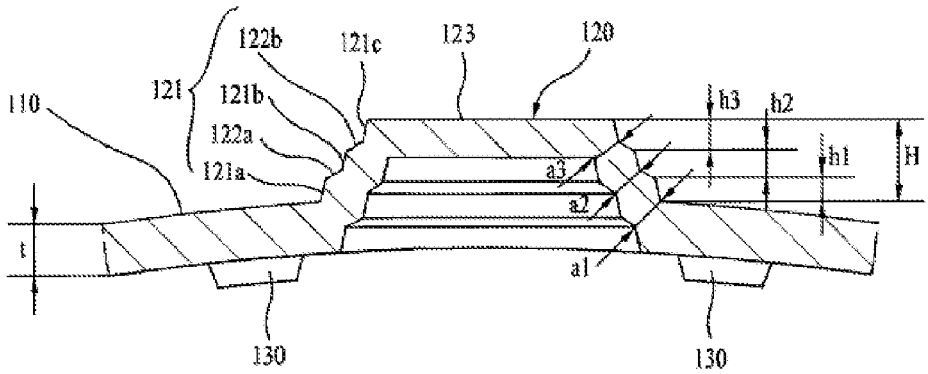
FIG. 8 is a cross-sectional view of a modified example of a pressure concentration projection shown in FIG. 6.

In addition, FIG. 8 is a cross-sectional view of a modified example of a pressure concentration projection 120 of the above-mentioned embodiment. As shown in the drawing, the pressure concentration projection 120 has a plurality of step surfaces 122*a* and 122*b* constituting the uplift part 121 and inclined in a projecting direction of the pressure concentration projection 120. According to the above constitution, the total height H of the pressure concentration projection 120 may be further increased as the plurality of step surfaces 122*a* and 122*b* are inclined in the projecting direction, in comparison with the above-mentioned embodiment.

While the embodiment of the present invention has illustrated the stepped pressure concentration projection 120 projecting in a circular shape, the projection may project in a triangular or rectangular shape.

Figure 9:
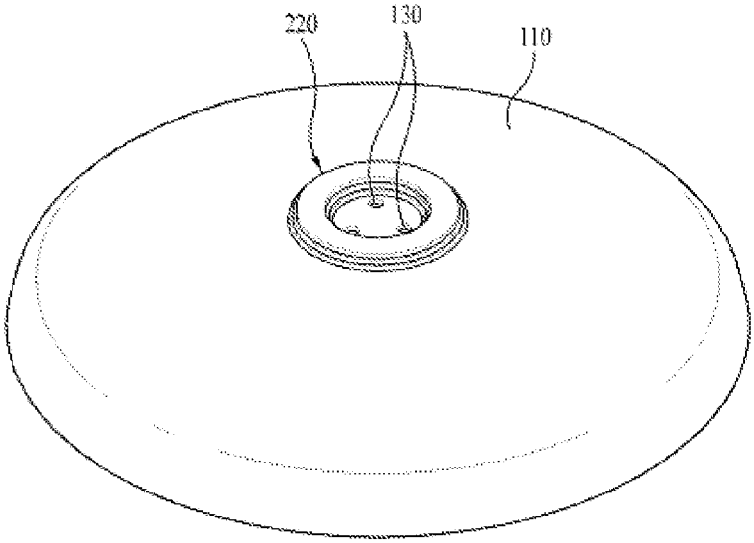
FIG. 9 is a perspective view of a metal dome switch in accordance with another exemplary embodiment of the present invention.
Figure 10:
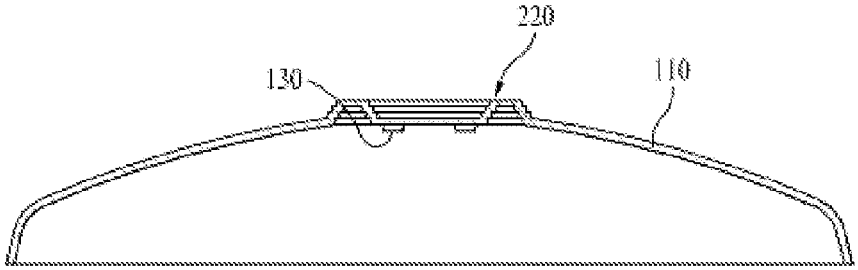
FIG. 10 is a cross-sectional view of the metal dome switch shown in FIG. 9.

In addition, as shown in FIGS. 9 and 10, instead of the stepped pressure concentration projection 120 of the above-mentioned embodiment, even when a stepped pressure concentration projection 220 projects from an apex of the dome-shaped metal plate 110 in an annular shape, the projection 220 can perform the same function as the above-mentioned embodiment. At this time, a plurality of downward contact protrusions 130 may be formed at an inner bottom surface of the stepped pressure concentration projection 220.

As can be seen from the foregoing, in a pressure concentration projection projecting upward from an apex of a dome-shaped metal plate and formed by a pressure forming process such as a bonding process or a half-blanking process, an uplift part of the pressure concentration projection is formed in a stepped shape having a plurality of uplift surfaces and a plurality of step surfaces, and a height of each uplift surface has a ⅓ to ½ t with respect to a material thickness t of the metal plate, so that the total height of the uplift part can be formed to 1.0 t or more of the material thickness t while maintaining structural strength of each uplift surface of the pressure concentration projection, thus maintaining an optimal state of click sensitivity upon a push operation of a key button. In addition, when a very small projection such as the pressure concentration projection is formed at the metal dome switch formed of a stainless steel material having high elasticity in a step shape, the small protrusion can be precisely formed at a desired position while minimizing deformation in appearance and dimension of the metal dome switch.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A metal dome switch for a keypad having a pressure concentration projection projecting from an apex of a dome-shaped metal plate and having an uplift part and a pressing surface, characterized in that the uplift part of the pressure concentration projection has a step shape formed of a plurality of uplift surfaces and a plurality of step surfaces by a press forming process such as a bending process or a half-blanking process using a punch and a die.

2. The metal dome switch for a keypad according to claim 1, wherein the total height of the uplift part is formed to 1.0 to 3.0 times of a material thickness of the metal plate, and the total height of the uplift part is determined by setting the number of the uplift surfaces and a height of each uplift surface.

3. The metal dome switch for a keypad according to claim 1, wherein the plurality of uplift surfaces are constituted by first to third uplift surfaces, and each height of the first to third uplift surfaces is formed to ⅓ to ½ of the material thickness of the metal plate.

4. The metal dome switch for a keypad according to claim 1, wherein the plurality of step surfaces are inclined in a projecting direction of the pressure concentration projection.

5. The metal dome switch for a keypad according to claim 1, wherein the stepped pressure concentration projection projects in an annular shape.

6. The metal dome switch for a keypad according to claim 1, further comprising a plurality of downward contact protrusions protruding downward from a periphery of the pressure concentration projection.

* * * * *